US005880556A

United States Patent [19]

Makimoto et al.

[11] Patent Number: 5,880,556

[45] Date of Patent: Mar. 9, 1999

[54] ELASTICALLY SUPPORTING HOLDER FOR A COLOR CATHODE-RAY TUBE

[75] Inventors: Shuuji Makimoto; Yonemichi Ochiai, both of Fukaya, Japan

[73] Assignee: Kabushhiki Kaisha Toshiba, Kawasaki, Japan

[21] Appl. No.: 774,175

[22] Filed: Dec. 26, 1996

[30] Foreign Application Priority Data

Dec. 26, 1995 [JP] Japan ..... 7-338365

[51] Int. Cl.[6] ..... H01J 29/80

[52] U.S. Cl. ..... 313/405

[58] Field of Search ..... 313/402, 404, 313/405, 407, 408

[56] References Cited

U.S. PATENT DOCUMENTS

| | | | |
|---|---|---|---|
| 3,803,436 | 4/1974 | Morrell . | |
| 4,659,958 | 4/1987 | D'Amato . | |
| 4,950,943 | 8/1990 | Ito | 313/404 |

FOREIGN PATENT DOCUMENTS

| | | |
|---|---|---|
| 1 462 936 | 12/1968 | Germany . |
| 2-135649 | 5/1990 | Japan . |

OTHER PUBLICATIONS

Patent Absracts Of Japan, vol. 012, No. 486 (E–695), Dec. 19, 1988 & JP 63 202825 A (NEC Corp)., Aug. 22, 1988.

Godfry et al. "Development of the Perma–Chrome Color Picture Tube, IEEE Transactions On Broadcast and Television Receivers", vol. btr, No. 14, Oct. 1968, New York, US pp. 8–11.

*Primary Examiner*—William Oen

*Attorney, Agent, or Firm*—Pillsbury Madison & Sutro LLP

[57] ABSTRACT

A holder elastically supporting a mask frame of a shadow mask has a holder body and a bimetal plate. The holder body is formed by bending an elongate metal plate in two opposite directions along first and second bending lines inclined at an angle to the longitudinal axis of the holder body, and has an engaging portion in engagement with a stud pin, a fixed portion fixed to the mask frame, and a slope portion extending aslant between the engaging portion and the fixed portion. The holder body moves the mask frame toward a phosphor screen along the central axis, when the mask frame is thermally expanded. The bimetal plate includes a first metal plate on the mask-frame side and a second metal plate on the holder-body side, the first and second metal plates having different thermal expansion coefficients and being stuck together. The bimetal plate is located between the fixed portion and the mask frame, for moving the mask frame away from the phosphor screen along the central axis of the face panel when heated.

15 Claims, 6 Drawing Sheets

ELASTICALLY SUPPORTING HOLDER FOR A COLOR CATHODE-RAY TUBE

BACKGROUND OF THE INVENTION

The present invention relates to a color cathode-ray tube, and more particularly, to a color cathode-ray tube in which a shadow mask is supported by elastic supporting members for compensating a deviation in beam landing attributable to thermal expansion of the shadow mask or a face panel.

In general, a color cathode-ray tube is provided with an envelope that includes a funnel and a substantially rectangular face panel having side wall sections on the peripheral edge portion of its effective section. A phosphor screen, including three phosphor layers that individually emit light of three different colors, blue, green, and red, is formed on the inner surface of the effective section of the face panel. In the envelope, a substantially rectangular shadow mask is opposed to the inside of the face panel. Provided in a neck of the funnel is an electron gun that emits three electron beams.

The electron beams emitted from the electron gun are deflected by a deflecting device, which is attached to the outside of the funnel, and are used to scan the phosphor screen in the horizontal and vertical directions through the shadow mask. Thereupon, a color image is displayed on the phosphor screen.

The shadow mask serves to sort the three electron beams from the electron gun by color so that they can correctly land on the three phosphor layers. The mask includes a substantially rectangular shadow mask body having a large number of electron beam apertures and a substantially rectangular mask frame attached to the peripheral portion of the mask body. At least three side wall sections of the mask frame are supported on the side wall sections of the face panel by means of elastic holders, individually, so that the shadow mask body faces the phosphor screen at a predetermined distance therefrom. Each holder has one end portion fixed to the mask frame and the other end portion anchored to a stud pin on the inner surface of each corresponding side wall section of the face panel.

In the color cathode-ray tube having the shadow mask, 30% or less of the electron beams emitted from the electron gun reach the phosphor screen through the electron beam apertures in the shadow mask body, while about 70% strike against the mask body. Thus struck by the electron beams, the shadow mask is heated and undergoes thermal expansion. When a high-brightness image is displayed, in particular, the relative positions between the electron beam apertures and the phosphor screen are shifted by thermal expansion of the mask body and the mask frame. Accordingly, electron beam spots shaped by the mask body cannot strike against or land on the phosphor layers of desired colors, so that the color purity is lowered inevitably.

Such color purity deteriorations during the operation of the color cathode-ray tube mainly include one attributable to the thermal expansion of the shadow mask body and one attributable to the thermal expansion of the mask frame.

The color purity deterioration attributable to the thermal expansion of the mask body is observed in the initial stage of high-brightness image display, and the electron beam landing position is shifted from a predetermined position toward the center of the phosphor screen in the radial direction thereof. This is caused by a doming effect such that the shadow mask body, having a small thermal capacity, bulges toward the phosphor screen, since it is heated while the mask frame, having a larger thermal capacity, is hardly heated.

On the other hand, the color purity deterioration attributable to the thermal expansion of the mask frame is caused as the electron beam landing position is shifted radially outward from the predetermined position on the phosphor screen. In this case, the doming effect of the shadow mask body is reduced as heat from the mask body is transmitted to the mask frame so that the external size of the mask frame is enlarged, while the peripheral portion of the mask body is pulled by the mask frame.

In order to restrain the color purity deterioration attributable to the thermal expansion of the shadow mask body, the shadow mask body itself should preferably be formed of a material with a low thermal expansion coefficient. In this case, however, a problem may possibly be aroused by the difference in the degree of thermal expansion between the shadow mask body and the mask frame that is attributable to the difference in the thermal expansion coefficient. If the shadow mask body is formed of a low-expansion material and is pulled beyond its thermal expandability by the thermal expansion of the mask frame, however, the mask body can be prevented from extending to the degree corresponding to the thermal expandability of the mask frame by giving an appropriate elasticity to a fixing portion between the mask body and the mask frame or by considering some other countermeasure. Accordingly, the color purity deterioration attributable to the thermal expansion of the mask frame can be also restrained to some extent. In the case of a high-precision color cathode-ray tube used in a computer display or the like, therefore, the shadow mask body is often formed of a low-expansion material, such as invar, to cope with its thermal expansion.

It is known that the color purity deterioration attributable to the thermal expansion of the mask frame can be corrected by suitably shaping the holder. According to this arrangement, the holder is formed of a belt-like member, which is obtained by bending a belt-shaped metal plate, and a bimetal member fixed to the mask frame. The mask-frame side of the bimetal member serves as a lower-expansion member, and the belt-like member side as a higher-expansion member. A fixing portion between the bimetal member and the mask frame is situated nearer to the phosphor screen than a fixing portion between the bimetal member and the belt member in the direction of the tube axis.

When heat from the mask frame is transmitted to the bimetal member during the high-brightness image display, according to this arrangement, the holder is tilted by the thermal expansion of the higher-expansion member, so that the angle of engagement between the holder and the stud pin changes. As the holder moves in this manner, the shadow mask body moves toward the phosphor screen, and the original electron beam apertures are corrected so as to be situated on the paths of the electron beams. Thus, the color purity deterioration is restrained.

In the case where the low-expansion material is used for the shadow mask body, as mentioned before, however, the color purity is lowered by the change of the ambient temperature. This is caused by the difference in the thermal expansion coefficient between glass as the material of the face panel and the low-expansion material, such as invar, for the shadow mask body.

More specifically, the color cathode-ray tube is shipped after it is adjusted so that optimum electron beam landing is ensured during its manufacturing processes. If the working temperature is different from the ambient temperature for the adjustment operation, then it is concluded that the ambient temperature is changed. If the ambient temperature for the adjustment operation and the working temperature for the cathode-ray tube are 20° C. and 40° C., respectively, a temperature difference of 20° C. is produced for all components of the tube.

The thermal expansion coefficient of invar for the shadow mask body, which is $1.2\times10^{-6}$° C., is about a tenth as high as that of glass, which is $10\times10^{-6}$° C. Thus, the degree of thermal expansion of the face panel exceeds that of the shadow mask body, so that the electron beam landing position is deviated inward from the predetermined position in the radial direction of the phosphor screen. When the ambient temperature changes descendingly, on the other hand, the degree of shrinkage of the face panel exceeds that of the shadow mask body, so that the electron beam landing position is deviated outward from the predetermined position in the radial direction of the phosphor screen.

Although the holders with the conventional construction can be effectively used for the correction of the color purity deterioration attributable to the thermal expansion of the mask frame, they accelerate the color purity deterioration attributable to the change of the ambient temperature. More specifically, the holders shift the electron beam landing position inward in the radial direction of the phosphor screen by moving the shadow mask body toward the phosphor screen. When the ambient temperature changes ascendingly, the bimetal member also undergoes thermal expansion, and the radially outward movement of the phosphor screen by the thermal expansion of the panel and the radially inward movement of the beam landing position are caused simultaneously. In consequence, deviations in the electron beam landing increase.

On the other hand, if the bimetal member of each holder is located on the other side so that the shadow mask body is shifted in the correcting direction against the change of the ambient temperature, in order to correct the color purity deterioration attributable to the ambient temperature change, then the color purity deterioration attributable to the thermal expansion of the mask frame will be accelerated.

Thus, deviations of the electron beam landing position, which cause the color purity deteriorations, occur in one direction when the mask frame is thermally expanded during the operation of the color cathode-ray tube, and in the opposite direction when the ambient temperature is changed. Accordingly, the holders that use bimetal cannot simultaneously correct the color purity deteriorations of the two kinds.

BRIEF SUMMARY OF THE INVENTION

The present invention has been contrived in consideration of these circumstances, and its object is to provide a color cathode-ray tube capable of correcting both of color purity deteriorations caused by the temperature change of a shadow mask and the change of the ambient temperature.

In order to achieve the above object, a color cathode-ray tube according to the present invention comprises: a face panel including a substantially rectangular effective section, four side wall sections set up along the peripheral edge portion of the effective section, stud pins individually protruding inward from at least three of the side wall sections; a phosphor screen formed on the inner surface of the effective section of the face panel; a shadow mask located inside the face panel and including a substantially rectangular mask body opposed to the phosphor screen and a substantially rectangular mask frame supporting the peripheral edge portion of the mask body and opposed to the side wall sections; a plurality of holders elastically supporting the mask frame on the face panel; and an electron gun for applying electron beams to the phosphor screen through the shadow mask.

Each of the holders includes a holder body for moving the mask frame toward the phosphor screen along the central axis of the face panel when the mask frame is thermally expanded so as to approach the side wall sections of the face panel, the holder body being formed by bending an elongate metal plate and having an engaging portion in engagement with the stud pin, a fixed portion fixed to the mask frame, and a slope portion extending aslant between the engaging portion and the fixed portion; and a bimetal section fixed to the fixed portion of the holder body and located between the fixed portion and the mask frame, for moving the mask frame away from the phosphor screen along the central axis of the face panel when heated.

According to the color cathode-ray tube constructed in this manner, the mask frame is also heated and thermally expanded outward as the shadow mask is heated so that the electron beam landing position is shifted outward in the radial direction of the phosphor screen. Accordingly, the holders are pressed against the side wall sections of the face panel by the mask frame, so that the extent of bending of the holder body is reduced. As this is done, the slope portion of each holder body shifts its position in a direction substantially perpendicular to its cross section, and a component of this shift in the direction of the central axis causes the shadow mask to move toward the phosphor screen.

At this time, the bimetal member also undergoes thermal expansion. Since the displacement of the shadow mask toward the phosphor screen, caused by the change of the shape of each holder body, is larger than a displacement in the opposite direction, which is attributable to the thermal expansion of the bimetal member, however, the shadow mask moves toward the phosphor screen, thereby restraining the color purity deterioration.

In the case where the ambient temperature is changed ascendingly, moreover, both the face panel and the mask frame are thermally expanded, so that the distance between the side wall sections of the face panel and the mask frame hardly changes. Accordingly, the position of the shadow mask is hardly shifted in the direction of the central axis by the change of the shape of each holder body, either. When the ambient temperature rises, therefore, the shadow mask is moved away from the phosphor screen by the action of the bimetal member of each holder alone, whereby the color purity deterioration is restrained.

Thus, the color cathode-ray tube according to the present invention can correct both the color purity deteriorations attributable to the thermal expansion of the shadow mask during the operation and the change of the ambient temperature.

In the color cathode-ray tube of the present invention, moreover, the holder body of each holder is bent along bending lines inclined at an angle to the longitudinal axis of the holder body that passes through its center in the transverse direction. More specifically, the holder body is bent in two stages along two parallel bending lines inclined at an angle to its longitudinal axis so that the angles between the fixed portion and the slope portion and between the slope portion and the engaging portion are wider than 90°. According to this arrangement, the cross section of the slope portion can be inclined at an angle to the tube axis.

Further, the bimetal section of each holder is formed by sticking together plate members with different thermal expansion coefficients on the mask-frame side and the holder-body side. The member of the bimetal section on the mask-frame side is formed as a higher-expansion member, and the phosphor-screen side of the bimetal section is fixed to the mask frame.

According to the color cathode-ray tube of the invention, furthermore, the thermal expansion coefficient of the shadow mask body is lower than that of the mask frame.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention and, together with the general description given above and the detailed description of the preferred embodiments given below, serve to explain the principles of the invention.

FIGS. 1 to 10 show a color cathode-ray tube according to an embodiment of the present invention, in which:

FIG. 1 is a longitudinal sectional view of the cathode-ray tube,

FIG. 2 is a front view showing a face panel and a shadow mask of the cathode-ray tube taken from the electron-gun side, FIG. 3 is a perspective view of a holder for supporting the shadow mask, FIG. 6 is a side view schematically showing the positional relationship between the shadow mask and the holder, FIG. 10 is a sectional view showing behavior of the holder when the ambient temperature increases;

FIGS. 12 and 13 show the principal part of a color cathode-ray tube according to another embodiment of the invention, in which:

FIG. 12 is a perspective view of a holder of the cathode-ray tube, and

FIG. 13 is a plan view of the holder.

DETAILED DESCRIPTION OF THE INVENTION

Color cathode-ray tubes according to preferred embodiments of the present invention will now be described in detail with reference to the accompanying drawings.

Figure 1:
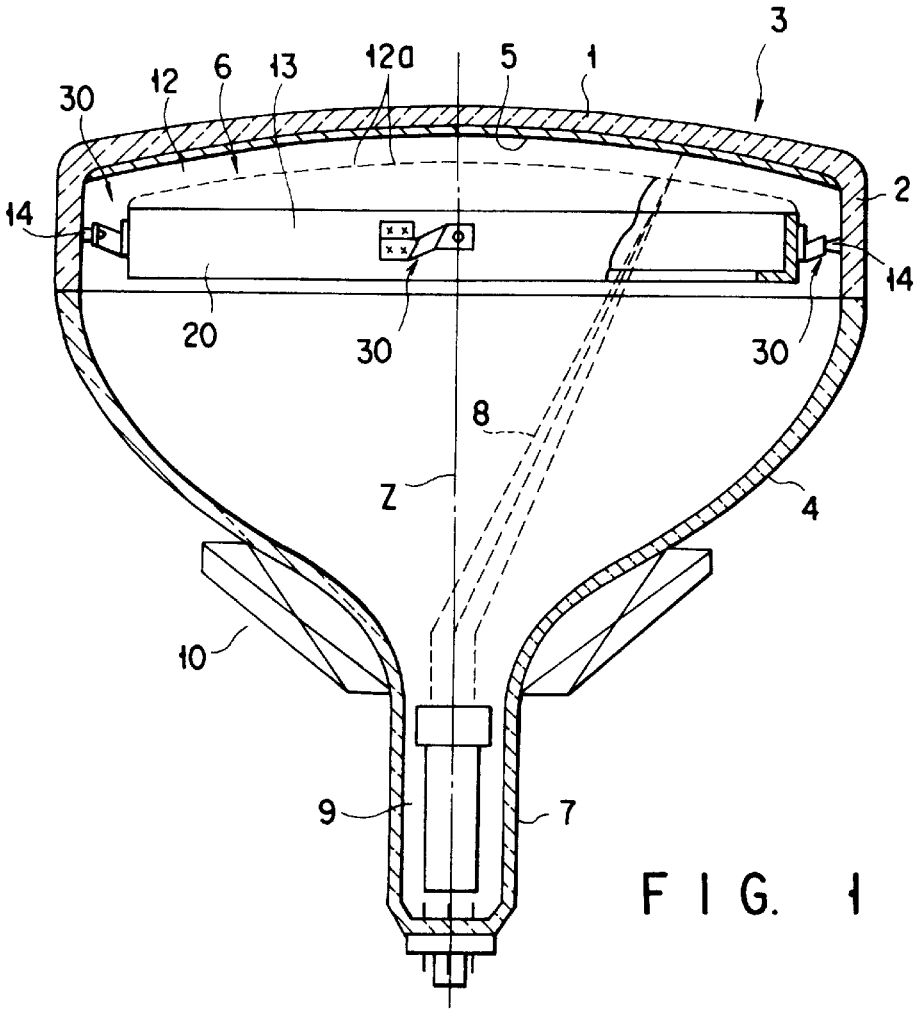
Figure 2:
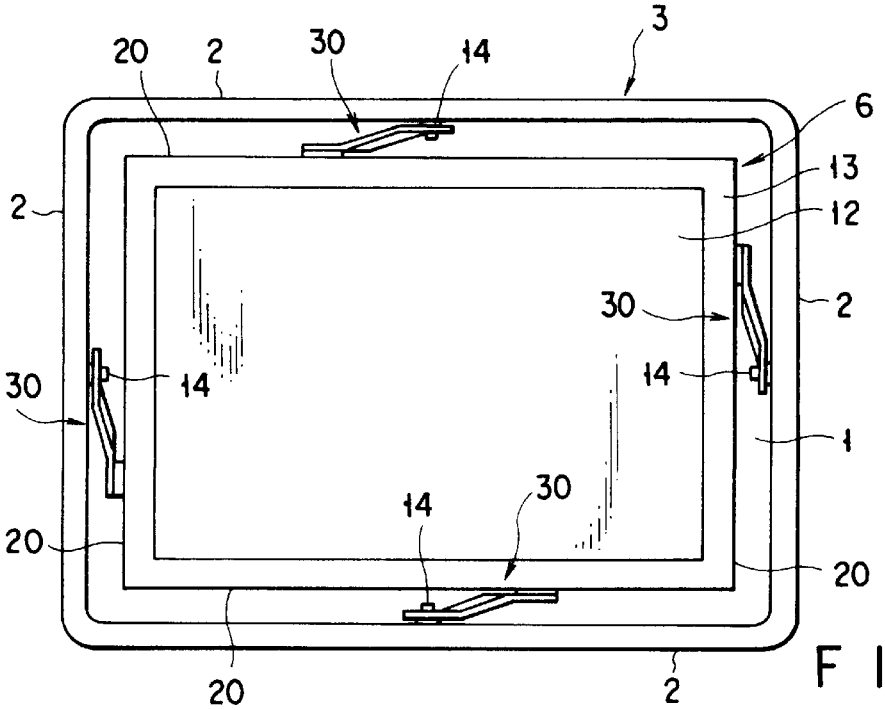
Figure 3:
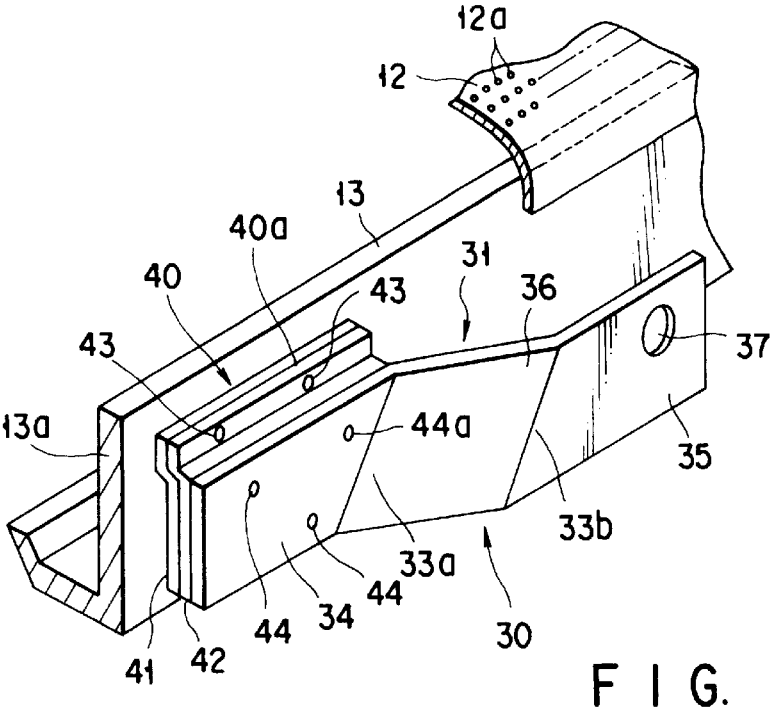

Referring to FIGS. 1 and 2, a color cathode-ray tube is provided with a vacuum envelope, which comprises a glass face panel 3 and a funnel 4. The face panel 3 includes a substantially rectangular effective section 1 and four side wall sections 2 set up along the peripheral edge portion of the effective section 1. The funnel 4 is connected to the side wall sections 2. A tapered stud pin 14 protrudes inward from the central portion of the inner surface of each side wall section 2. A phosphor screen 5, including a number of phosphor layers that individually emit light beams of three different colors, blue, green, and red, is formed on the inner surface of the effective section 1. Further, a substantially rectangular shadow mask 6 is arranged inside the face panel 3 so as to face the screen 5.

Located inside a neck 7 of the funnel 4, on the other hand, is an electron gun 9 that emits three electron beams 8. The three beams 8 emitted from the electron gun 9 are deflected by a deflecting device 10, which is attached to the outside of the funnel 4, and are used to scan the phosphor screen 5 in the horizontal and vertical directions through the shadow mask 6. Thereupon, a color image is displayed on the screen 5.

The shadow mask 6 includes a substantially rectangular mask body 12 having a large number of electron beam apertures 12*a* and a rectangular mask frame 13 supporting the peripheral edge portion of the mask body. The mask body 12 and the mask frame 13 are formed of invar (thermal expansion coefficient: $1.2\times10^{-6}$/°C.) and iron (thermal expansion coefficient: $12\times10^{-6}$/°C.), respectively.

The mask frame 13 has four wall sections 20, which extend parallel to the central axis of the face panel 3, that is, a tube axis Z of the color cathode-ray tube, and face their corresponding side wall sections 2 of the panel 3 at a predetermined distance therefrom. Each wall section 20 has an L-shaped profile. Also, each wall section 20 of the mask frame 13 is supported on the face panel 3 by means of a holder 30 in a manner such that the mask body 12 faces the phosphor screen 5 at a predetermined distance therefrom.

As shown in FIGS. 2 to 5B, each holder 30 is composed of a holder body 31, which is formed by bending an elongate rectangular metal plate, and a bimetal plate 40 fixed to the holder body.

The holder body 31 is bent in two stages along two parallel bending lines 33*a* and 33*b* that are inclined at an angle θ (θ<90°) to its longitudinal central axis 32. The angle θ is set at 45°, for example. The directions of bending along the lines 33*a* and 33*b* are opposite to each other, and bending angles α and β are wider than 90°. The holder body 31, thus bent in two stages, includes a fixed portion 34 on one end side thereof, an engaging portion 35 on the other end side, and a slope portion 36 situated between the portions 34 and 35, that is, between the bending lines 33*a* and 33*b*. The engaging portion 35 is formed having a circular hole 37. The fixed portion 34 is fixed to the mask frame 13 through the bimetal plate 40, while the engaging portion 35 is supported on the face panel 3 with the stud pin 14 penetrating the hole 37. The holder body 31 is formed of a material, such as stainless SUS 420 (thermal expansion coefficient: $11\times10^{-6}$/°C.), whose thermal expansion coefficient is lower than that of the mask frame 13.

The bimetal plate 40 is formed by joining two metal plates with different thermal expansion coefficients. More specifically, the plate 40 is formed of a first metal plate 41 with a relatively high thermal expansion coefficient ($20\times10^{-6}$/°C.) and a second metal plate 42 with a relatively low thermal expansion coefficient ($5\times10^{-6}$/°C.) that are stuck together. The first and second metal plates 41 and 42 are located on the mask-frame side and the holder-body side, respectively.

The fixed portion 34 of the holder body 31 is fixed on the second metal plate 42 of the bimetal plate 40. The bimetal plate 40 and the fixed portion 34 are fixed to each other by spot-welding in a plurality of spots, e.g., three spots 44. One side edge portion of the bimetal plate 40 projects from the fixed portion 34 and is bent to form a stepped fixing portion 40*a*. The plate 40 is fixed to the mask frame 13 by spot-welding in a plurality of spots, e.g., two spots 43, on the stepped fixing portion 40*a*. Only that portion of the first metal plate 41 which corresponds to the fixing portion 40*a* is in contact with the mask frame 13, and the remaining portion of the plate 41 faces the frame 13 with a space between them.

As shown in FIGS. 4A, 4B, 5A and 5B, each holder 30 thus constructed is fixed to the mask frame 13 in a manner such that the central axis 32 of the fixed portion 34 of the holder body 31 extends parallel to the longitudinal axis of a wall section 13*a* of the frame 13. The holder 30 is supported on the face panel 3 in a manner such that the stud pin 14 protruding from its corresponding side wall section 2 of the face panel 3 is fitted in the hole 37 in the engaging portion 35 of the holder body 31. In this state, the fixed portion 34 and the engaging portion 35 of the holder body 31 extend substantially parallel to each other, and the wall section 13*a* of the mask frame 13 and the side wall section 2 of the face panel 3 face each other in substantially parallel relation.

Figure 4A:
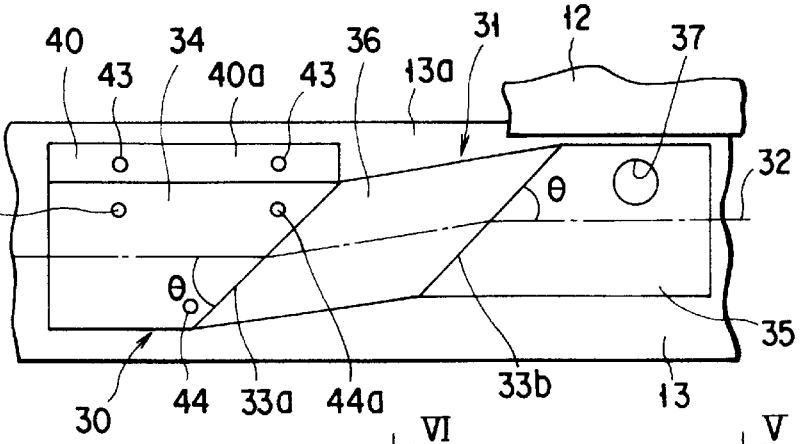
FIG. 4A is a front view of the holder.
Figure 4B:
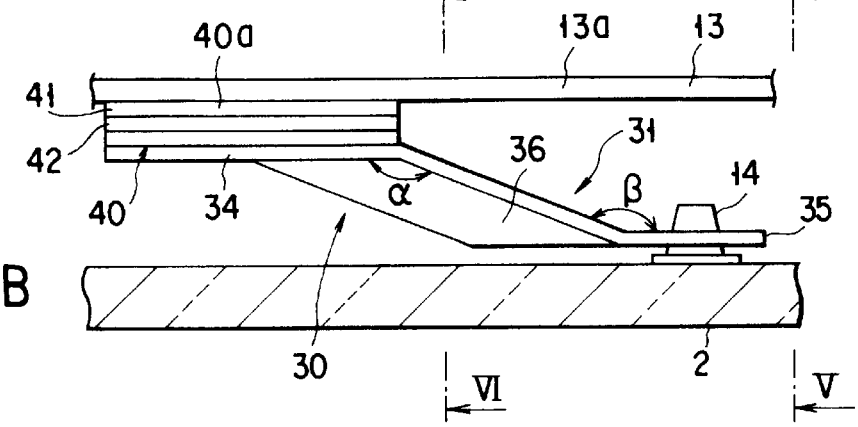
FIG. 4B is a plan view of the holder.
Figure 5A:
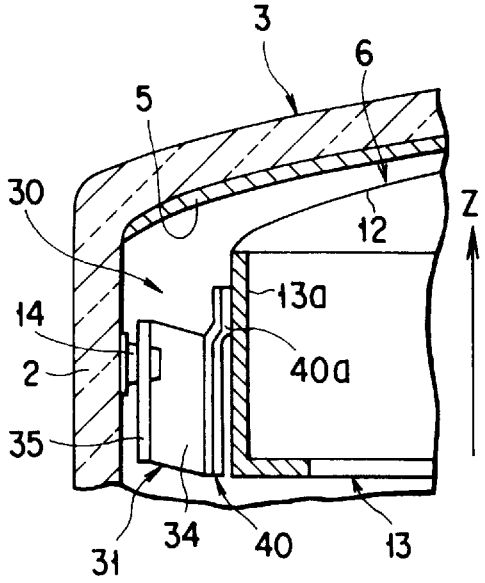
FIG. 5A is a sectional view taken along line V—V of FIG. 4B.
Figure 5B:
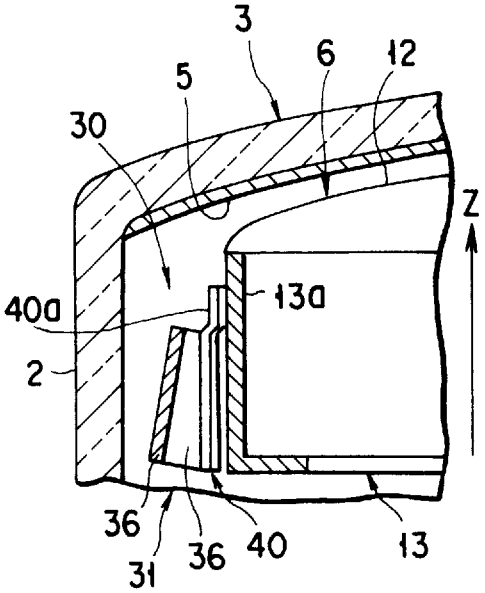
FIG. 5B is a sectional view taken along line VI—VI of FIG. 4B.

The holder body 31 is bent along the bending lines 33*a* and 33*b* that are inclined at the angle θ to the central axis 32, ascending to the right, as shown in FIG. 4A, in particular. Accordingly, the engaging portion 35 of the holder body 31 is engagement with the stud pin 14 in a position nearer to the phosphor screen 5 than the fixed portion 34 in the direction along the tube axis Z. The slope portion 36 of the holder body 31 is inclined at angles to two perpendicular axes that extend in the direction of the tube axis Z and at right angles thereto, individually. The weld spots 43 between the fixing portion 40*a* of the bimetal plate 40 and the mask frame 13 are situated nearer to the phosphor screen 5 than the weld spots 44 between the bimetal plate 40 and the holder body 31 in the direction of the tube axis Z.

Figure 6:
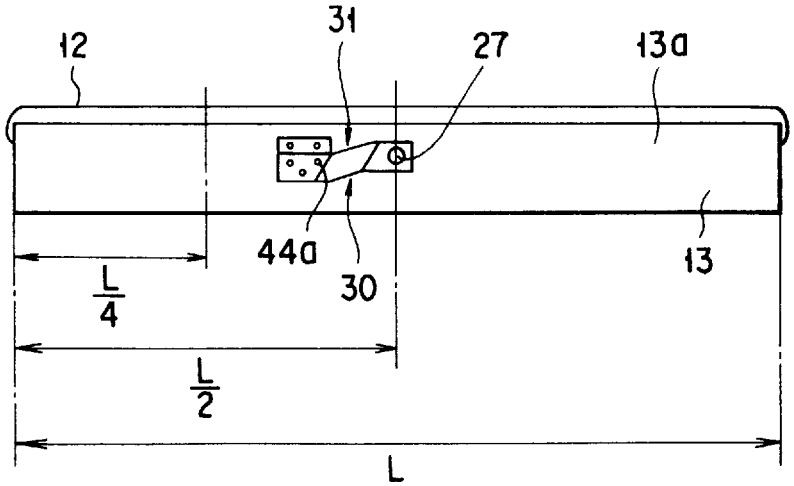

As shown in FIG. 6, the stud pin 14 that protrudes from each side wall section 2 of the face panel 3 is located in the center of the side wall section 2 with respect to the longitudinal direction thereof. Each holder 30 that faces its corresponding pin 14 is fixed to the mask frame 13 in a manner such that the hole 37 in the engaging portion 35 faces the center of the wall section 13*a* of the mask frame 13 with respect to the longitudinal direction thereof. If the length of the wall section 13*a* of the mask frame 13 is L, the length of the holder body 31 is adjusted so that a weld spot 44*a* is situated at a distance of L/4 to L/2 from one longitudinal end of the wall section 13*a* of the mask frame 13. Among the weld spots 44 between the holder body 31 and the bimetal plate 40, the weld spot 44*a* is nearest to the bending line 33*a* on the side of the fixed portion 34 and nearest to the fixing portion 40*a* of the bimetal plate 40.

The following is a description of the operation of the holders 30 constructed in the manner described above. The holder operation serves for the correction of the color purity lowered by thermal expansion of the mask frame 13 during the operation of the color cathode-ray tube and for the correction of the color purity lowered by the change of the ambient temperature.

When the color cathode-ray tube is actuated, the mask body 12 is heated by the electron beams, and the resulting heat is transmitted to the mask frame 13. Thereupon, the frame 13 undergoes thermal expansion, and each wall section 13*a* moves from the position indicated by broken line in FIG. 7A toward its corresponding side wall section 2. As this is done, the mask body 12 is pulled by the mask frame 13 and also moves in the same direction. In this case, the electron beam apertures 12*a* of the mask body 12 move radially outward with respect to the phosphor screen 5, as shown in FIG. 7B, so that each electron beam 8 transmitted through the apertures 12*a* to the screen 5 is landed in a position deviated radially outward with respect to a specific phosphor layer 51. This causes a color purity deterioration.

Figure 7A:
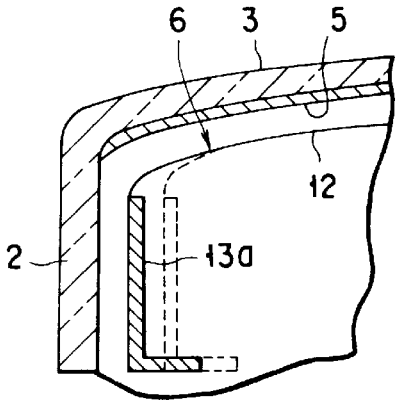
FIG. 7A is a sectional view showing a mask frame subjected to thermal expansion.
Figure 7B:
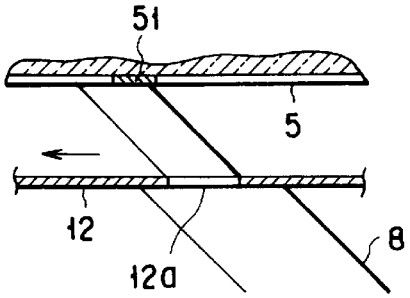
FIG. 7B is a schematic view showing the way the electron beam landing position is shifted by the thermal expansion of the mask frame.
Figure 7C:
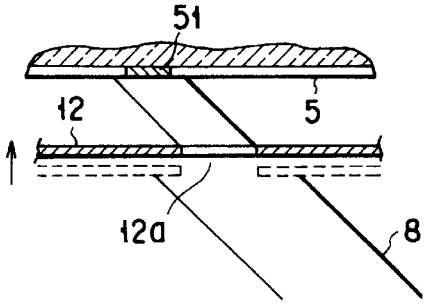
FIG. 7C is a schematic view showing the necessary movement of the shadow mask for the correction of a deviation in the electron beam landing.
Figure 8A:
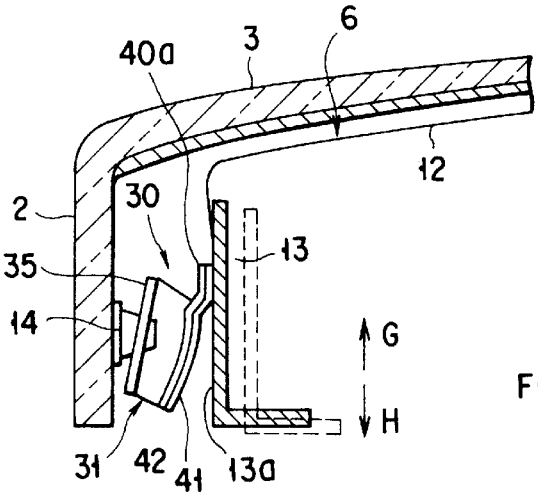
FIGS. 8A and 8B are a sectional view and a side view individually showing behaviors of the holder caused by the thermal expansion of the mask frame.
Figure 8C:
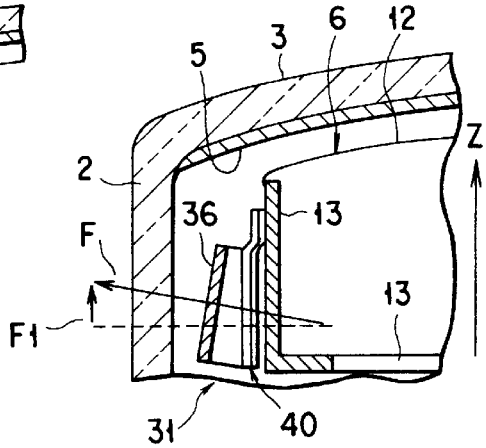
FIG. 8C is a sectional view showing behavior of the holder body caused by the thermal expansion of the mask frame.
Figure 8B:
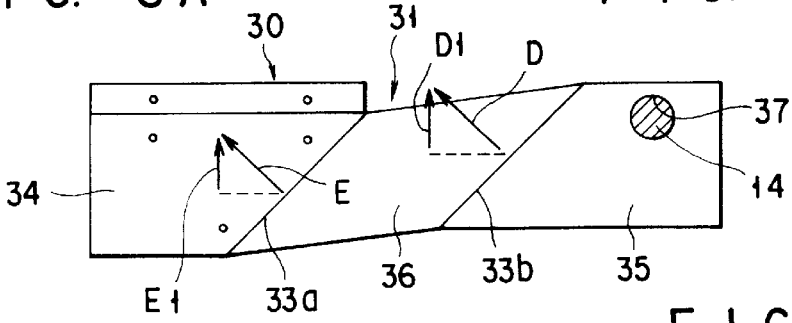

In such a case, each holder 30 causes the mask body 12 to move toward the phosphor screen 5, from a normal position indicated by broken line in FIG. 7C to a corrected position indicated by full line, thereby correcting the landing position of the electron beam 8 so as to be coincident with the position of the specific phosphor layer 51. More specifically, when the mask frame 13 is thermally expanded during the operation of the color cathode-ray tube, the face panel 3 undergoes no thermal expansion, so that the distance between the wall sections 13*a* of the frame 13 and their corresponding side wall sections 2 of the panel 3 is shortened. Accordingly, the holder body 31 of each holder 30 between the wall sections is compressed, as shown in FIGS. 8A to 8C. As a result, the holder body 31 is deformed in a direction such that the angles α and β between the fixed portion 34 and the slope portion 36 and between the engaging portion 35 and the slope portion 36 become wider. In this case, the engaging portion 35 of the holder body 31 is fixedly in engagement with the stud pin 14, so that the slope portion 36 moves in a direction D perpendicular to the bending line 33*b* with respect to the engaging portion 35, while the fixed portion 34 moves in a direction E perpendicular to the bending line 33*a* with respect to the slope portion 36. Since the shift directions D and E contain components D1 and E1, respectively, in the direction of the tube axis Z, the slope portion 36 and the fixed portion 34 move along the tube axis Z toward the phosphor screen 5.

When the holder body 31 is compressed, moreover, the slope portion 36 is deflected. By this deflection, the slope portion 36 moves in a direction F perpendicular to its surface, as shown in FIG. 8C. Since the slope portion 36 is inclined at an angle to the tube axis Z, however, the movement in the direction F contains a component F1 in the direction of the tube axis Z. As the slope portion 36 is deflected, therefore, the fixed portion 34 of the holder body 31 moves along the tube axis Z toward the phosphor screen 5.

When the mask frame 13 is heated during the operation of the color cathode-ray tube, on the other hand, the bimetal plate 40 of each holder 30 is also heated and thermally expanded. As this is done, the first metal plate 41 of the bimetal plate 40, which is located on the mask-frame side, undergoes a greater thermal expansion than the second metal plate 42 on the holder-body side. As shown in FIG. 8A, therefore, the bimetal plate 40 is deformed into an arcuate shape such that the first metal plate 41 is on the outer peripheral side, and that end portion of the plate 40 opposite from the fixing portion 40*a* is deformed so as to recede from the corresponding wall section 13*a* of the mask frame 13. Thereupon, the holder body 31 is inclined downward along the taper surface of the stud pin 14, thereby urging the mask frame 13 to move away from the phosphor screen 5.

However, a displacement G of the mask frame 13 toward the phosphor screen 5 that is attributable to the aforesaid change of the shape of the holder body 31 is greater than a displacement H in the opposite direction that is caused by the deformation of the bimetal plate 40. Therefore, the whole shadow mask 6 is moved from its normal position toward the phosphor screen 5 by the holders 30. Thus, a color purity deterioration can be corrected.

The following is a description of the way of restraining the color purity deterioration attributable to the change of the ambient temperature, especially in the case where the ambient temperature is increased.

Figure 9A:
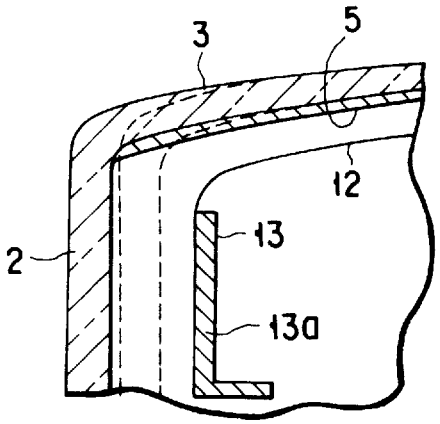
FIG. 9A is a sectional view showing the face panel subjected to thermal expansion.

If the ambient temperature during the operation of the color cathode-ray tube is higher than the ambient temperature for the adjustment operation of the shadow mask in the manufacturing processes for the tube, the glass face panel 3 undergoes a greater thermal expansion than the mask body 12 that is formed of invar, as shown in FIG. 9A. On the other hand, the mask frame 13, which is formed of iron, undergoes a thermal expansion substantially equally to the face panel 3, and pulls the mask body 12. Since that portion of the mask body 12 which is fixed to the mask frame 13 has suitable elasticity, however, the mask body 12 cannot be substantially moved even though it is pulled by the frame 13.

Figure 9B:
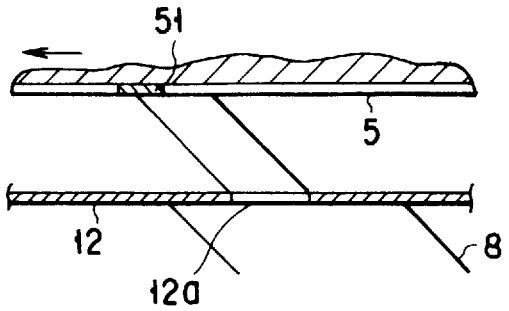
FIG. 9B is a schematic view showing the way the electron beam landing position is shifted by the thermal expansion of the face panel.

Accordingly, the specific phosphor layer 51 of the phosphor screen 5 moves radially outward with respect to the mask body 12, so that each electron beam 8 transmitted through the electron beam apertures 12*a* is landed in a position deviated radially inward with respect to the phosphor layer 51, as shown in FIG. 9B. This causes a color purity deterioration.

Figure 9C:
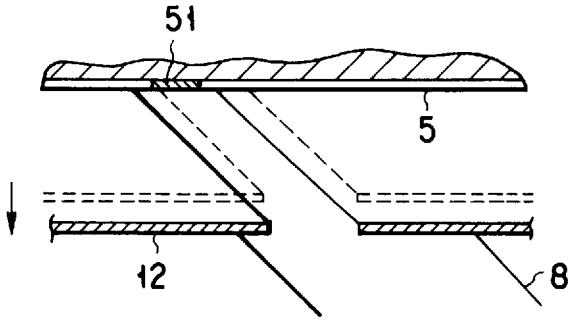
FIG. 9C is a schematic view showing the necessary movement of the shadow mask for the correction of a deviation in the electron beam landing.

In such a case, each holder 30 causes the mask body 12 to move away from the phosphor screen 5, from a normal position indicated by broken line in FIG. 9C to a corrected position indicated by full line, thereby correcting the landing position of the electron beam 8 so as to be coincident with the position of the specific phosphor layer 51.

Figure 10:
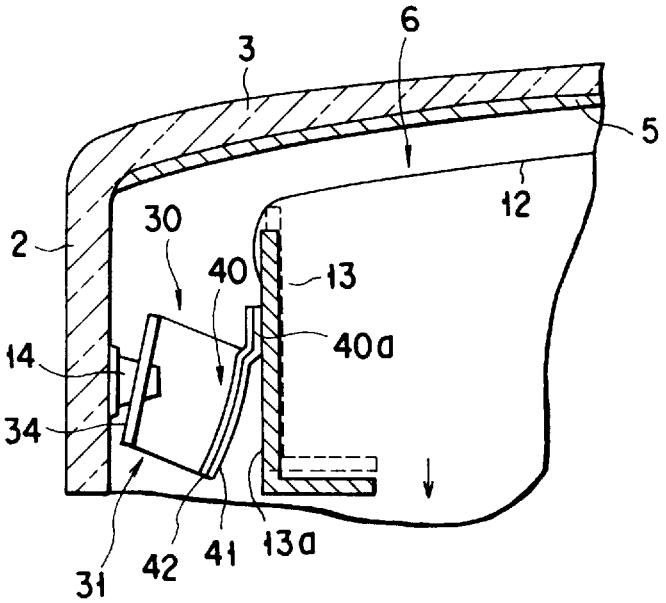

When the ambient temperature increases, the bimetal plate 40 of each holder 30, along with the face panel 3 and the mask frame 13, undergoes thermal expansion. As mentioned before, in this case, the thermal expansion of the first metal plate 41 of the bimetal plate 40 is greater than that of the second metal plate 42, and that end portion of the plate 40 opposite from the fixing portion 40*a* moves away from the mask frame 13. Thereupon, the angle of engagement between the holder body 31 and the stud pin 14 changes so that the holder body 31 tilts downward, a shown in FIG. 10. As a result, the mask frame 13 is moved away from the phosphor screen 5 by the holder 30. Thus, the color purity deterioration is corrected.

Since the thermal expansion coefficient of the mask frame 13 of iron is substantially equal to that of the face panel 3 of glass, the distance between side wall sections 2 of the face panel and the mask frame wall sections 13*a* hardly change despite the increase of the ambient temperature. Thus, the mask frame 13 cannot be moved by the change of the shape of each holder body 31, and the color purity deterioration can be corrected by only the action of the bimetal plate 40 when the ambient temperature is increased.

The following Table shows results of comparison between the color cathode-ray tube constructed in the aforesaid manner and conventional color cathode-ray tubes in the inhibitory effect against the color purity deterioration.

In Table, Comparative Example 1 is a color cathode-ray tube that is provided with no measure to counter either of the color purity deteriorations attributable to the thermal expansion of a mask frame and the change of the ambient temperature, and in which a mask body formed of invar is supported by means of holders. Each holder has a holder body which is formed by bending a belt-shaped metal plate along bending lines perpendicular to the longitudinal axis of the metal plate.

Comparative Example 2 is a color cathode-ray tube that is provided with a measure to counter the color purity deterioration attributable to the thermal expansion of a mask frame, and in which a mask body formed of invar is supported by means of holders. Each holder has a holder body with the same structure as in the Example 1 and a bimetal for correcting the color purity deterioration due to the thermal expansion of the mask frame.

Comparative Example 3 is a color cathode-ray tube that is provided with a measure to counter the color purity deterioration attributable to the change of the ambient temperature, and in which a mask body formed of invar is supported by means of holders. Each holder has a holder body with the same structure as in the Example 1 and a bimetal for correcting the color purity deterioration due to the change of the ambient temperature.

In Table, moreover, the color purity deteriorations are represented by deviations of the electron beam landing position, "+" and "−" indicating outward and inward dislocations, respectively, in the radial direction of the phosphor screen.

TABLE

| | Color Deterioration by Thermal Expansion of Frame Change (μm) | Color Deterioration by Ambient Temperature Change (μm) |
|---|---|---|
| Present Embodiment | 0 | −10 |
| Comparative Example 1 | +10 | −50 |
| Comparative Example 2 | 0 | −60 |
| Comparative Example 3 | +30 | −30 |

As seen from Table, Comparative Examples 1 to 3 are subject to one or both of the color purity deteriorations attributable to the thermal expansion of the mask frame and the change of the ambient temperature. In the color cathode-ray tube according to the present embodiment, on the other hand, both the color purity deteriorations can be corrected satisfactorily.

According to the color cathode-ray tube constructed in this manner, each holder body 31 is deformed to cope with the thermal expansion of the shadow mask during operation by utilizing the change of the distance between the side wall sections of the face panel and the mask frame wall sections, and the color purity deterioration is corrected by converting the change of the holder shape into a movement of the shadow mask in the direction of the tube axis Z. On the other hand, the color purity deterioration attributable to the ambient temperature change is corrected by utilizing the deformation of the bimetal plate. Thus, the color deteriorations in the opposite directions can be corrected efficiently.

It is to be understood that the present invention is not limited to the embodiment described above, and that various changes and modifications may be effected therein by one skilled in the art without departing from the scope or spirit of the invention.

According to the embodiment described above, for example, the holder body of each holder is bent in two stages at an angle wider than 90°. However, each holder according to the present invention must only be designed so that the cross section of its slope portion is inclined at an angle to the tube axis, and is not limited to the above embodiment.

Figure 11:
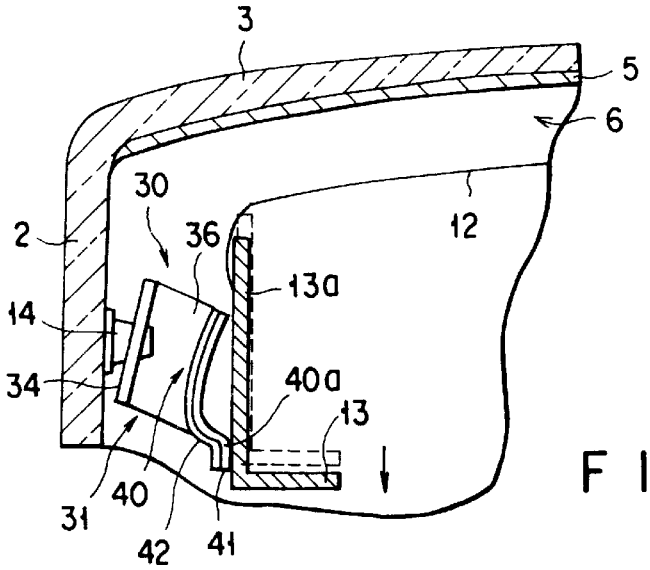
FIG. 11 is a sectional view showing behavior of a holder when the ambient temperature increases, in a color cathode-ray tube having a holder according to a modification of the present invention.

According to the foregoing embodiment, moreover, that portion of the bimetal plate 40 of each holder which faces the mask frame wall section is formed of a high thermal expansion material, and the fixing portion 40*a* of the bimetal plate fixed to the mask frame wall section is situated on the screen-side end portion of the bimetal plate. Alternatively, as shown in FIG. 11, the relation between the respective thermal expansion coefficients of the first and second metal plates 41 and 42 of the bimetal plate 40 may be inverted so that the second metal plate 42 on the holder-body side is formed of a high thermal expansion material, and that the fixing portion 40*a* of the plate 40 is situated on the gun-side end portion of the plate 40 in the direction of the tube axis Z.

In this case, the screen-side end portion of the bimetal plate 40 opposite from the fixing portion 40*a* is moved toward the mask frame 13 by thermal expansion, so that the holder 30 is inclined toward the electron gun with respect to the stud pin 14, and the shadow mask 6 is moved away from the phosphor screen 5.

The bimetal plate is not limited to the aforesaid structure composed of the two metal plates with different thermal expansion coefficients that are stuck together, and may be of any of various other structures. Further, the present invention is not limited to the aforementioned configuration of the electron beam apertures of the shadow mask, and may be applied to any arrangement such that the mask frame can undergo thermal expansion.

During the manufacturing processes for the color cathode-ray tube constructed in the manner described above, the shadow mask 6 is attached to and detached from the face panel a plurality of times as the phosphor screen is formed on the inner surface of the face panel. Accordingly, each holder 30 is expected to be easily attached to and detached from its corresponding stud pin on the face panel. When the shadow mask is fitted on the face panel, therefore, it is preferable that the engaging portion 35 of the holder 30 is located at right angles to the central axis of the stud pin 14 so that the peripheral edge portion of the aperture 37 is evenly in engagement with the stud pin. On the other hand, each holder is expected to have predetermined elasticity in order to hold the shadow mask accurately in position. To obtain this springiness, each holder should be subject to some elastic deformation when the shadow mask is fitted on the face panel.

Figure 12:
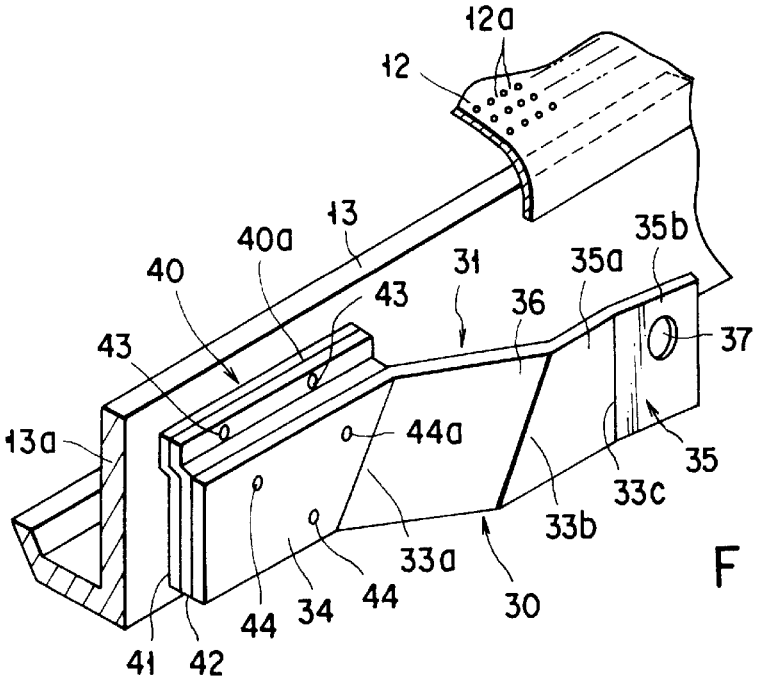
Figure 13:
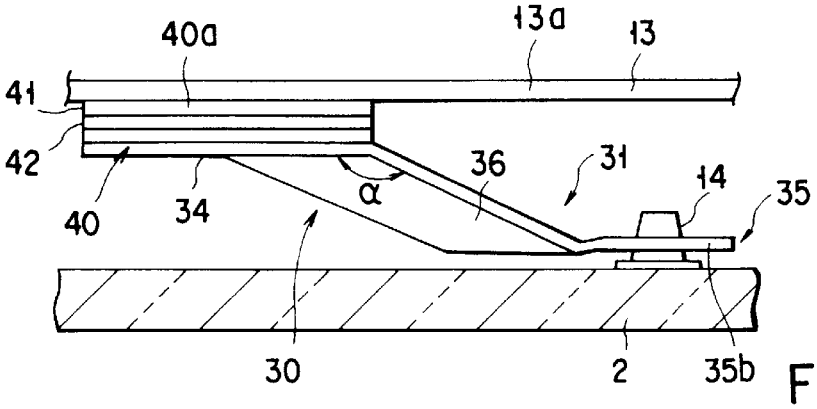

According to a modification of the present invention shown in FIGS. 12 and 13, the holder body 31 of the holder 30 is additionally bent at the engaging portion 35 so that the engaging portion can be held securely at right angles to the stud pin 14 even though the holder 30 is somewhat elastically deformed with the shadow mask on the face panel.

More specifically, the engaging portion 35 is bent at a predetermined angle, e.g., 4°, along a bending line 33*c* perpendicular to the longitudinal axis of the holder body, so as to recede from the mask frame 13. Thus, the engaging portion 35 is composed of a first portion 35*a* situated between the bending lines 33*b* and 33*c* and a second portion 35*b* situated between the bending line 33*c* and one end of the holder body 31. The hole 37 is formed in the second portion 35.

When the shadow mask 6 is attached to the face panel 3 with the stud pin 14 fitted in the hole 37 of the holder 30 constructed in the manner described above, the holder body 31 is compressed and elastically deformed. When the holder body 31 is elastically deformed, as shown in FIG. 13, the second portion 35*b* of the engaging portion 35 extends at right angles to the central axis of the stud pin 14. Thus, the peripheral edge portion of the aperture 37 evenly engages the stud pin 14, thereby ensuring smooth attachment and detachment.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A color cathode-ray tube comprising:

a face panel including a substantially rectangular effective section, four side wall sections set up along the peripheral edge portion of the effective section, stud pins individually protruding inward from at least three of the side wall sections;

a phosphor screen formed on the inner surface of the effective section of the face panel;

a shadow mask located inside the face panel and including a substantially rectangular mask body opposed to the phosphor screen and a substantially rectangular mask frame supporting the peripheral edge portion of the mask body and opposed to the side wall sections;

a plurality of holders elastically supporting the mask frame on the face panel; and an electron gun for applying electron beams to the phosphor screen through the shadow mask, each of the holders including:

a holder body for moving the mask frame toward the phosphor screen along the central axis of the face panel when the mask frame is thermally expanded so as to approach the side wall sections of the face panel, the holder body being formed by bending an elongate metal plate and having an engaging portion in engagement with the stud pin, a fixed portion fixed to the mask frame, and a slope portion extending aslant between the engaging portion and the fixed portion; and a bimetal section fixed to the fixed portion of the holder body and located between the fixed portion and the mask frame, for moving the mask frame away from the phosphor screen along the central axis of the face panel when heated.

2. A color cathode-ray tube according to claim 1, wherein the holder body of each holder is bent along a bending line inclined at an angle to the longitudinal axis of the holder body, and the engaging portion is situated nearer to the phosphor screen than the fixed portion in the direction of the central axis of the face panel.

3. A color cathode-ray tube according to claim 1, wherein the holder body of each holder is bent in two opposite directions along first and second bending lines inclined at an angle to the longitudinal axis of the holder body, the first and second bending lines defining the boundaries between the fixed portion and the slope portion and between the slope portion and the engaging portion, respectively, and the engaging portion is situated nearer to the phosphor screen than the fixed portion in the direction of the central axis of the face panel.

4. A color cathode-ray tube according to claim 3, wherein the angle between the fixed portion and the slope portion and the angle between the slope portion and the engaging portion are wider than 90°.

5. A color cathode-ray tube according to claim 3, wherein the two bending lines extend parallel to each other.

6. A color cathode-ray tube according to claim 3, wherein the mask frame has four wall sections individually facing the corresponding side wall sections of the face panel at a predetermined distance therefrom, and each holder is attached to each corresponding wall section of the mask frame in a manner such that the respective longitudinal axes of the fixed portion and the engaging portion extend substantially parallel to the longitudinal axis of the wall section.

7. A color cathode-ray tube according to claim 1, wherein the bimetal section includes a first metal plate on the mask-frame side and a second metal plate on the holder-body side, the first and second metal plates having different thermal expansion coefficients and being stuck together.

8. A color cathode-ray tube according to claim 7, wherein the first metal plate has a thermal expansion coefficient higher than that of the second metal plate, and the bimetal section includes a fixing portion fixed to the mask frame and situated nearer to the phosphor screen in the extending direction of the central axis of the face panel.

9. A color cathode-ray tube according to claim 7, wherein the first metal plate has a thermal expansion coefficient lower than that of the second metal plate, and the bimetal section includes a fixing portion fixed to the mask frame and situated nearer to the electron gun in the extending direction of the central axis of the face panel.

10. A color cathode-ray tube according to claim 1, wherein the mask body has a thermal expansion coefficient lower than that of the mask frame.

11. A color cathode-ray tube according to claim 1, wherein the holder body has a thermal expansion coefficient lower than that of the mask frame.

12. A color cathode-ray tube according to claim 3, wherein the engaging portion of the holder body includes first and second portions formed by bending the engaging portion along a third bending line substantially perpendicular to the longitudinal axis of the holder body, the first portion being situated between the second and third bending lines and the second portion being situated between the third bending line and one end of the holder body, and the engaging portion has a hole formed in the second portion for receiving the stud pin, the second portion being bent along the third bending line so that the second portion is situated at right angles to the central axis of the stud pin when the holder body is elastically deformed to be in engagement with the stud pin.

13. A color cathode-ray tube according to claim 2, wherein each stud pin is located in the central portion of each corresponding side wall section of the face panel with respect to the longitudinal direction thereof, the mask frame has four wall sections individually facing the corresponding side wall sections of the face panel at a predetermined distance therefrom, the fixed portion of each holder body is fixed to the bimetal section at a plurality of regions thereof, and each holder is fixed to each corresponding wall section of the mask frame so that one of the fixed regions of the fixed portion that is nearest to the engaging portion of the holder body and nearest to the bending line is situated at a distance longer than ¼ of the length of the mask frame wall section from one end of the mask frame wall section in the longitudinal direction, between the stud pin and the one end of the mask frame wall section.

14. A color cathode-ray tube comprising:

a face panel including a substantially rectangular effective section, four side wall sections set up along the peripheral edge portion of the effective section, stud pins individually protruding inward from at least three of the side wall sections;

a phosphor screen formed on the inner surface of the effective section of the face panel;

a shadow mask located inside the face panel and including a substantially rectangular mask body opposed to the phosphor screen and a substantially rectangular mask frame supporting the peripheral edge portion of the mask body and opposed to the side wall sections;

a plurality of holders elastically supporting the mask frame on the face panel; and an electron gun for applying electron beams to the phosphor screen through the shadow mask, each of the holders including:

a holder body formed by bending an elongated metal plate in two opposite directions along first and second bending lines inclined at an angle to the longitudinal axis of the holder body, and having an engaging portion in engagement with the stud pin, a fixed portion fixed to the mask frame, and a slope portion extending aslant between the engaging portion and the fixed portion, the engaging portion being situated nearer to the phosphor screen than the fixed portion in the direction of the central axis of the face panel; and a bimetal section fixed to the fixed portion of the holder body and located between the fixed portion and the mask frame, the bimetal section including a first metal plate on the mask-frame side and a second metal plate on the holder-body side, the first metal plate having a thermal expansion coefficient higher than that of the second metal plate, and the bimetal section having a fixing portion fixed to the mask frame and situated nearer to the phosphor screen in the extending direction of the central axis of the face panel.

15. A color cathode-ray tube comprising:

a face panel including a substantially rectangular effective section, four side wall sections set up along the peripheral edge portion of the effective section, stud pins individually protruding inward from at least three of the side wall sections;

a phosphor screen formed on the inner surface of the effective section of the face panel;

a shadow mask located inside the face panel and including a substantially rectangular mask body opposed to the phosphor screen and a substantially rectangular mask frame supporting the peripheral edge portion of the mask body and opposed to the side wall sections;

a plurality of holders elastically supporting the mask frame on the face panel; and an electron gun for applying electron beams to the phosphor screen through the shadow mask, each of the holders including:

a holder body formed by bending an elongated metal plate in two opposite directions along first and second bending lines inclined at an angle to the longitudinal axis of the holder body, and having an engaging portion in engagement with the stud pin, a fixed portion fixed to the mask frame, and a slope portion extending aslant between the engaging portion and the fixed portion, the engaging portion being situated nearer to the phosphor screen than the fixed portion in the direction of the central axis of the face panel; and a bimetal section fixed to the fixed portion of the holder body and located between the fixed portion and the mask frame, the bimetal section including a first metal plate on the mask-frame side and a second metal plate on the holder-body side, the first metal plate having a thermal expansion coefficient higher than that of the second metal plate, and the bimetal section having a fixing portion fixed to the mask frame and situated nearer to the phosphor screen in the extending direction of the central axis of the face panel;

the engaging portion of each holder including first and second portions formed by bending the engaging portion along a third bending line substantially perpendicular to the longitudinal axis of the holder body, the first portion being situated between the second and third bending lines and the second portion being situated between the third bending line and one end of the holder body, and a hole formed in the second portion for receiving the stud pin, the second portion being bent along the third bending line so that the second portion is situated at right angles to the central axis of the stud pin when the holder body is elastically deformed to be in engagement with the stud pin.

* * * * *